US009862511B2

(12) United States Patent
Lanzarini et al.

(10) Patent No.: US 9,862,511 B2
(45) Date of Patent: Jan. 9, 2018

(54) PROCESSING METHOD AND UNIT FOR AUTOMATICALLY OPENING A HINGED-LID SLIDE-OPEN PACKAGE OF TOBACCO PRODUCTS

(71) Applicant: G.D SOCIETA' PER AZIONI, Bologna (IT)

(72) Inventors: Luca Lanzarini, Crespellano (IT); Luca Testoni, Castelmaggiore (IT); Ivanoe Bertuzzi, Casalecchio Di Reno (IT); Michele Squarzoni, Ferrara (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 784 days.

(21) Appl. No.: 14/365,657

(22) PCT Filed: Dec. 21, 2012

(86) PCT No.: PCT/IB2012/057650
§ 371 (c)(1),
(2) Date: Jun. 16, 2014

(87) PCT Pub. No.: WO2013/093893
PCT Pub. Date: Jun. 27, 2013

(65) Prior Publication Data

US 2014/0305084 A1 Oct. 16, 2014

(30) Foreign Application Priority Data

Dec. 22, 2011 (IT) ..... BO2011A0747

(51) Int. Cl.
*B65B 43/00* (2006.01)
*B65B 49/00* (2006.01)
(Continued)

(52) U.S. Cl.
CPC ..... *B65B 19/28* (2013.01); *B65B 19/18* (2013.01); *B65B 19/20* (2013.01); *B65B 19/22* (2013.01);
(Continued)

(58) Field of Classification Search
CPC ..... B65B 43/24; B65B 19/20; B65B 19/18; B65B 2230/04; B65B 43/31; B65B 43/39; B65B 43/00; B65B 69/00
(Continued)

(56) References Cited

U.S. PATENT DOCUMENTS 2,441,445 A * 5/1948 Ringler ..... B65B 43/10 229/145
3,802,325 A * 4/1974 Bardenhagen ..... B65B 19/20 493/148
(Continued)

FOREIGN PATENT DOCUMENTS

GB 1603109 A * 11/1981 ..... B65B 19/20

OTHER PUBLICATIONS

International Search Report and Written Opinion, corresponding International Application No. PCT/IB2012/057650, dated Apr. 19, 2013.
(Continued)

*Primary Examiner* — Hemant M Desai
*Assistant Examiner* — Eyamindae Jallow
(74) *Attorney, Agent, or Firm* — Marshall, Gerstein & Borun LLP

(57) ABSTRACT

A processing method for automatically opening a slide-open package of tobacco articles with a hinged lid; the processing method including the steps of: mechanically clamping an outer container of the package; exerting pull on the lid to rotate the lid into an open position by means of a first actuator, which contacts a top wall of the lid, and has a
(Continued)

suction head which engages the top wall by suction; and, simultaneously and in coordination with the step of exerting pull on the lid, exerting thrust on an inner container of the package, to slide the inner container axially with respect to the outer container, by means of a second actuator, which contacts a wall of the inner container through a window formed through a corresponding wall of the outer container.

14 Claims, 13 Drawing Sheets

(51) Int. Cl.

| | |
|---|---|
| ***B65B 19/28*** | (2006.01) |
| ***B65B 19/20*** | (2006.01) |
| ***B65B 61/00*** | (2006.01) |
| ***B65B 19/18*** | (2006.01) |
| ***B65B 19/22*** | (2006.01) |
| ***B65B 57/02*** | (2006.01) |
| ***B65D 5/38*** | (2006.01) |
| ***B65D 85/10*** | (2006.01) |

(52) U.S. Cl.
CPC ..... *B65B 57/02* (2013.01); *B65B 61/00* (2013.01); *B65D 5/38* (2013.01); *B65D 85/1045* (2013.01); *B65B 2230/04* (2013.01)

(58) Field of Classification Search
USPC ..... 53/50, 169, 382.1, 382.2, 382.3, 457, 53/458, 492
See application file for complete search history.

(56) References Cited

U.S. PATENT DOCUMENTS

| | | | | |
|---|---|---|---|---|
| 3,884,013 | A * | 5/1975 | Solomon | B65B 5/06 53/158 |
| 4,049,117 | A * | 9/1977 | Grimm | B65D 5/6688 206/270 |
| 4,646,960 | A | 3/1987 | Challand | |
| 7,992,708 | B2 * | 8/2011 | Hein | B65D 5/38 206/249 |
| 2011/0041463 | A1 | 2/2011 | Squarzoni et al. | |
| 2011/0155796 | A1 * | 6/2011 | Moore | B65D 5/38 229/120.08 |

OTHER PUBLICATIONS

International Preliminary Report on Patentability, corresponding International application No. PCT/IB2012/057650, dated Jun. 24, 2014.

* cited by examiner

PROCESSING METHOD AND UNIT FOR AUTOMATICALLY OPENING A HINGED-LID SLIDE-OPEN PACKAGE OF TOBACCO PRODUCTS

CROSS-REFERENCE TO RELATED APPLICATIONS

This is the U.S. national phase of International Application No. PCT/IB012/057650, filed Dec. 21, 2012, which claims the benefit of Italian Patent Application No. BO2011A000747, filed Dec. 22, 2011.

TECHNICAL FIELD

The present invention relates to a processing method and unit for automatically opening a hinged-lid slide-open package of tobacco articles.

In the following description, reference is made, for the sake of simplicity and purely by way of example, to a hinged-lid, slide-open packet of cigarettes.

BACKGROUND ART

Rigid, hinged-lid packets of cigarettes are currently the most widely marketed, by being easy to produce and easy and practical to use, and by effectively protecting the cigarettes inside.

In addition to the above rigid, hinged-lid packets cigarettes, rigid slide-open packets have been proposed comprising two partly separable containers, one inserted inside the other. In other words, a rigid, slide-open packet of cigarettes comprises an inner container, which houses a foil-wrapped group of cigarettes and is housed inside an outer container to slide, with respect to the outer container, between a closed configuration, in which the inner container is inserted inside the outer container, and an open configuration, in which the inner container is partly extracted from the outer container.

A rigid, hinged-lid, slide-open packet cigarettes has also been proposed in which the outer container has a hinged lid, which rotates between a closed position and an open position closing and opening an open top end of the outer container. The outer container lid has a connecting tab connected at one end to the lid, and at the other end to the inner container, to 'automatically' rotate the lid (i.e. without the user having to touch the lid) as the inner container slides with respect to the outer container.

Some embodiments of rigid, hinged-lid, slide-open packets of cigarettes, however, have proved difficult to open the first time (i.e. the first time the inner container is slid out with respect to the outer container to rotate the lid into the open position), even to the extent of giving the user the impression the packet is somehow defective. The reason for this difficulty lies in the packing material the packet is made from initially resisting deformation along the hinge lines. That is, locally, the packing material is still substantially whole, and is only weakened locally (the mechanical bonds within the material are only broken or at any rate relaxed) when the packet is opened the first time.

To make first-time opening of the packet easier for the user, it has been proposed to open and close the newly completed packet of cigarettes at a processing station downstream from the last packing station. The packet is opened and closed automatically by a mechanical actuator at the processing station. The mechanical actuators used in known processing stations, however, have the drawback of handling the packet fairly roughly, thus possibly resulting in irreparable damage, and of being highly unreliable (i.e. guaranteeing no certainty of success of the operation).

DESCRIPTION OF THE INVENTION

It is an object of the present invention to provide a processing method and unit for automatically opening a hinged-lid, slide-open package of tobacco articles, designed to eliminate the above drawbacks, and which are cheap and easy to implement.

According to the present invention, there are provided a processing method and unit for automatically opening a hinged-lid, slide-open package of tobacco articles, as claimed in the accompanying Claims.

BRIEF DESCRIPTION OF THE DRAWINGS

A number of non-limiting embodiments of the present invention will be described by way of example with reference to the accompanying drawings, in which.

PREFERRED EMBODIMENTS OF THE INVENTION

Figure 2:
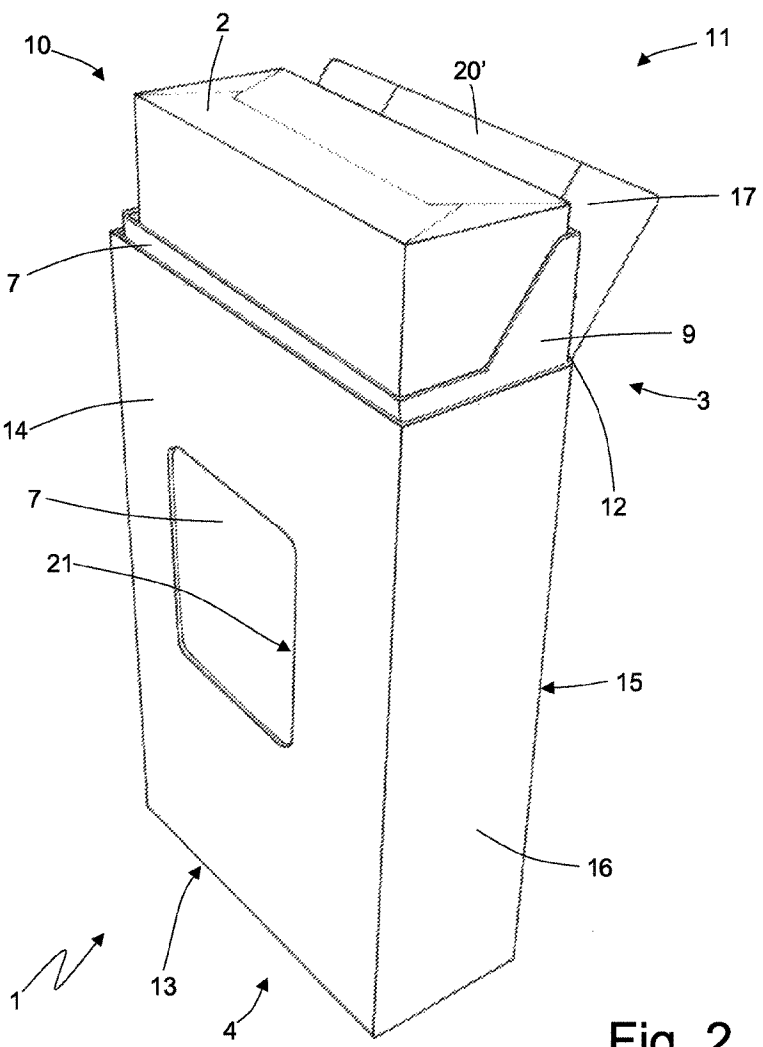
FIG. 2 shows a front view in perspective of the FIG. 1 packet of cigarettes in an open configuration.
Figure 1:
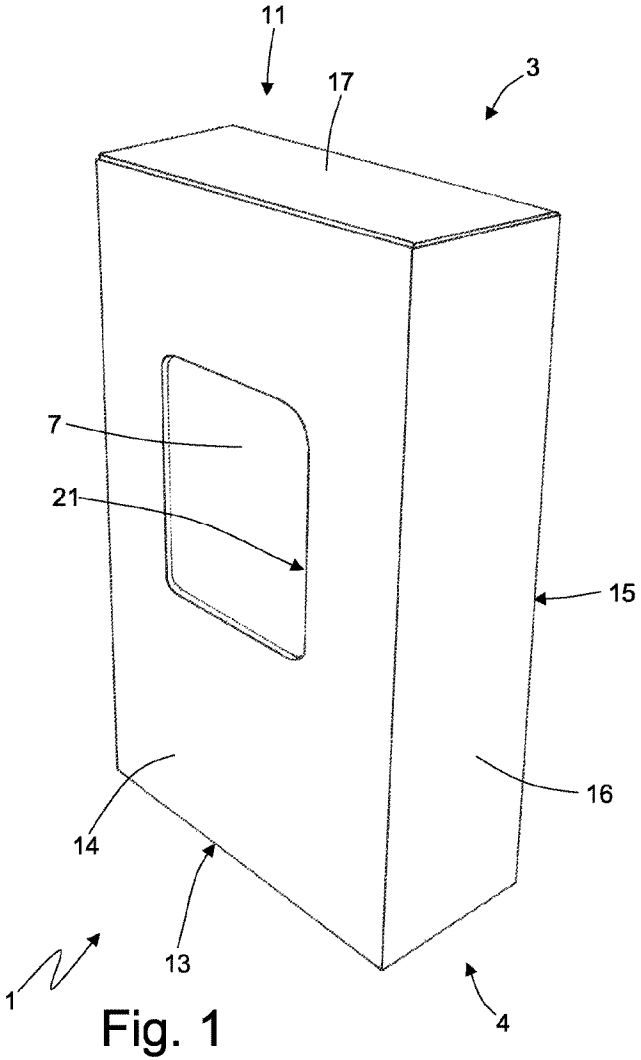
FIG. 1 shows a front view in perspective of a rigid, hinged-lid, slide-open packet of cigarettes, in accordance with the present invention and in a closed configuration.

Number 1 in FIGS. 1 and 2 indicates as a whole a rigid, slide-open packet of cigarettes, which opens in a translatory (linear) movement.

The FIG. 1 packet 1 of cigarettes comprises a wrapped, i.e. foil-wrapped group 2 of cigarettes (shown in FIG. 2). Packet 1 of cigarettes also comprises a rigid inner container 3 actually containing the wrapped group 2 of cigarettes; and a rigid outer container 4, which houses inner container 3 to allow inner container 3 to slide in a translatory movement, with respect to outer container 4, between a closed configuration (FIG. 1), in which inner container 3 is inserted fully inside outer container 4, and an open configuration (FIG. 2), in which inner container 3 is partly extracted from outer container 4 to allow access to wrapped group 2 of cigarettes.

Figure 5:
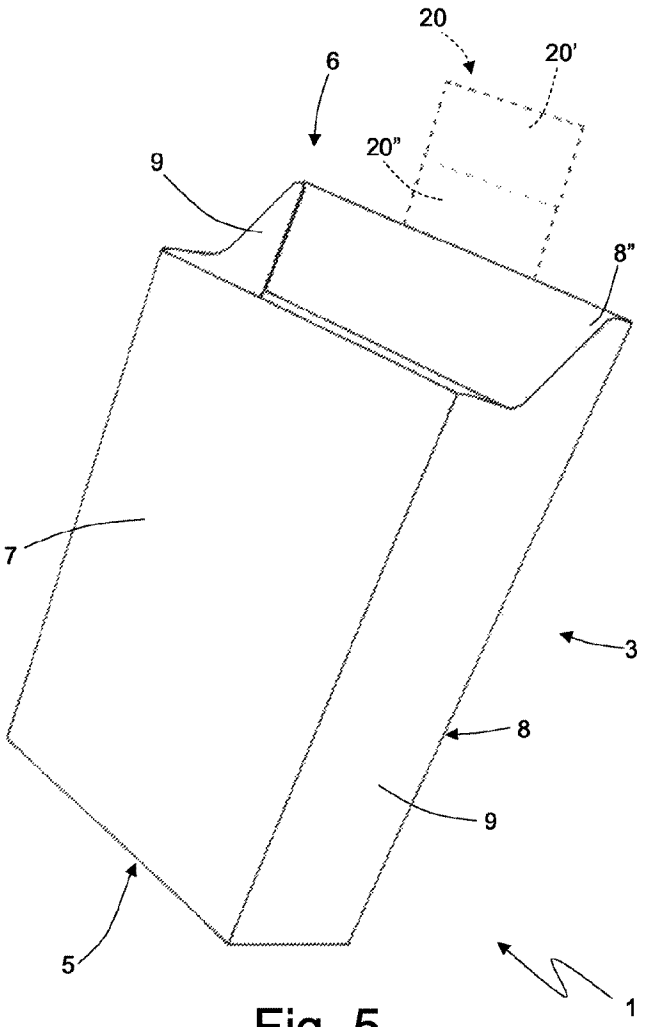
FIG. 5 shows a front view in perspective of an inner container of the FIG. 1 packet of cigarettes without the group of cigarettes and with a connecting tab.

As shown in FIG. 5, inner container 3 is parallelepiped-shaped, and comprises a bottom wall 5; an open top end 6 opposite bottom wall 5; a front wall 7 and rear wall 8 opposite and parallel to each other; and two parallel lateral walls 9 interposed between walls 7 and 8.

Figure 3:
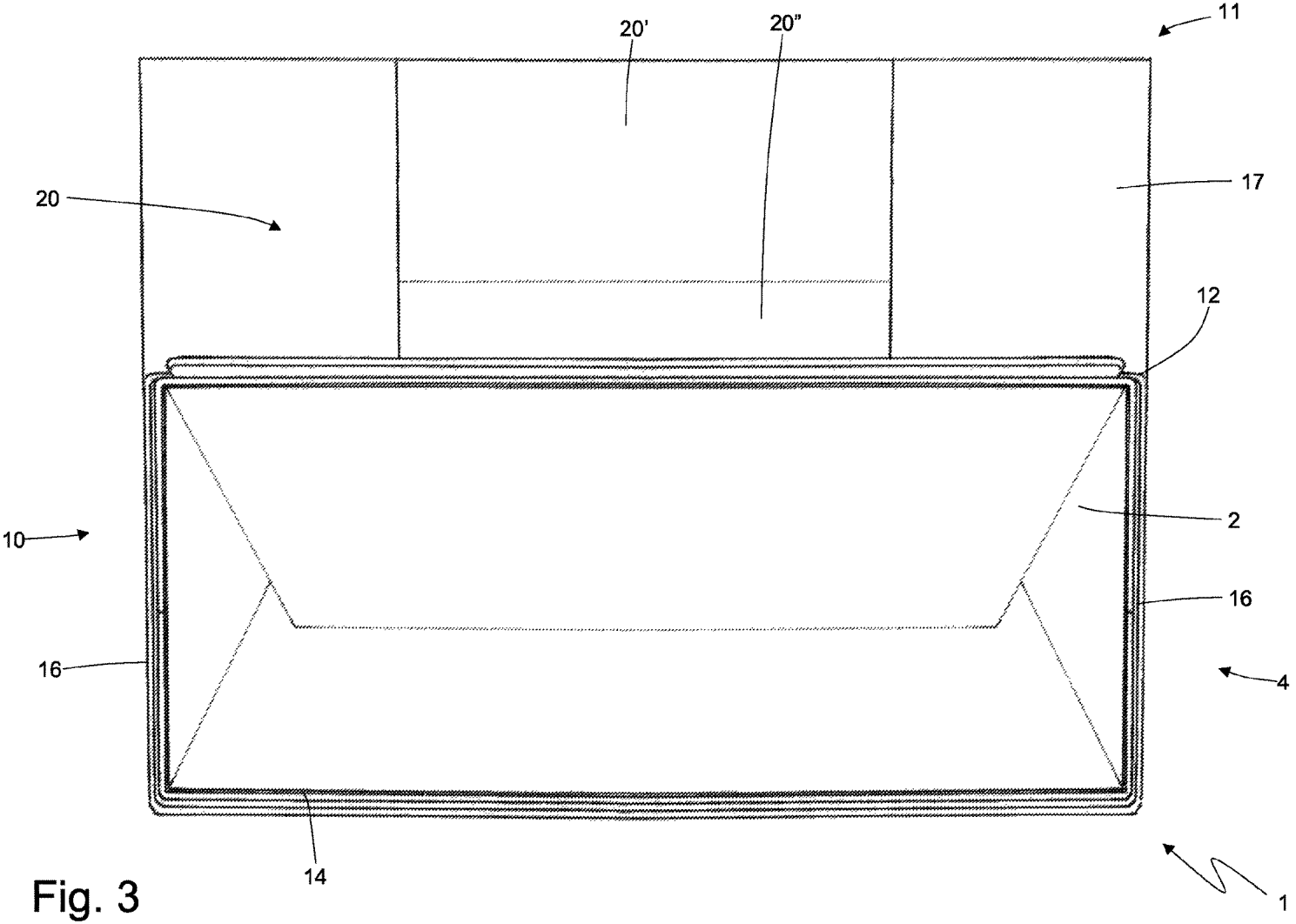
FIG. 3 shows a top plan view of the FIG. 1 packet of cigarettes in an open configuration.
Figure 4:
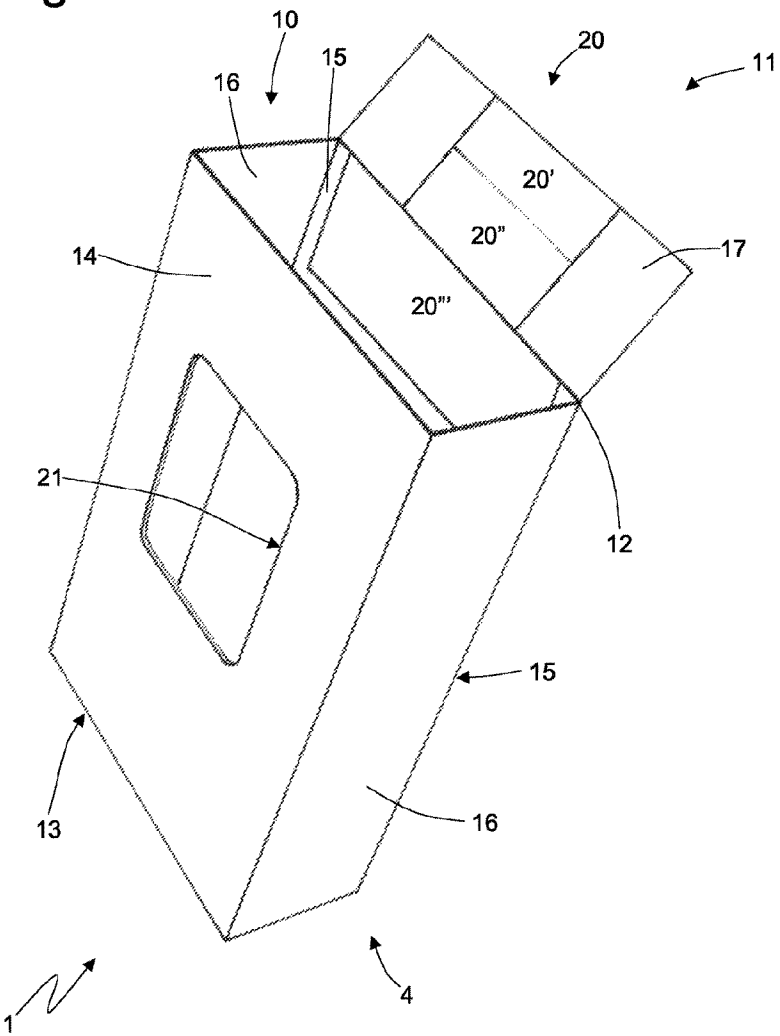
FIG. 4 shows a front view in perspective of an outer container of the FIG. 1 packet of cigarettes.

As shown in FIG. 4, outer container 4 has an open top end 10; and a cup-shaped lid 11 hinged to outer container 4 along a hinge 12 to rotate, with respect to outer container 4, between an open position (FIGS. 2, 3 and 4) and a closed position (FIG. 1) respectively opening and closing open top end 10 of outer container 4 and, at the same time, also open top end 6 of inner container 3. Outer container 4 is parallelepiped-shaped, and comprises a bottom wall 13 opposite open top end 10; a front wall 14 and rear wall 15 opposite and parallel to each other; and two parallel lateral walls 16 interposed between walls 14 and 15.

Lid 11 is cup-shaped, and comprises a top wall 17 which closes open top end 10 of outer container 4 when the lid is closed; a front wall 18; and two lateral walls 19. Top wall 17 of lid 11 is 'flat' (i.e. is formed from one cardboard panel or a number of compacted cardboard panels, and is therefore solid), while walls 18 and 19 of lid 11 are 'box' walls (i.e. are formed from two spaced cardboard panels and are therefore hollow) with a triangular cross section. When lid 11 is closed, walls 18 and 19 of lid 11 fit inside open top end 10 of outer container 4, so top wall 17 of lid 11 is flush with the top edges of walls 14, 15 and 16 or outer container 4.

In a preferred embodiment, rear wall 8 of inner container 3 is connected to top wall 17 of lid 11 by a connecting tab 20 to rotate lid 11 'automatically' (i.e. without the user having to touch lid 11) as inner container 3 slides with respect to outer container 4. In other words, by means of connecting tab 20 connecting top wall 17 of lid 11 mechanically to rear wall 8 of inner container 3, inner container 3, as it slides with respect to outer container 4 from the closed to the open configuration, pushes lid 11 from the closed to the open position 'automatically' (i.e. without the user having to touch lid 11); and similarly, as inner container 3 slides with respect to outer container 4 from the open to the closed configuration, lid 11 is pushed by inner container 3 from the open to the closed position 'automatically' (i.e. without the user having to touch lid 11). The user therefore need simply exert sufficient thrust to slide inner container 3 with respect to outer container 4, without having to touch lid 11, which is rotated 'automatically'. Preferably, connecting tab 20 is connected seamlessly to lid 11, and is glued to rear wall 8 of inner container 3.

As shown in FIGS. 1, 2 and 4, front wall 14 of outer container 4 has a through window 21 allowing access to underlying front wall 7 of inner container 3 facing front wall 14 of outer container 4, to exert thrust on inner container 3 to move it between the closed and open configurations. In other words, to use packet 1 of cigarettes, the user holds outer container 4 with one hand and, with the thumb of the same hand, pushes on front wall 7 of inner container 3 through window 21 in front wall 14 of outer container 4, to exert thrust on inner container 3 and slide it with respect to outer container 4.

Figure 6:
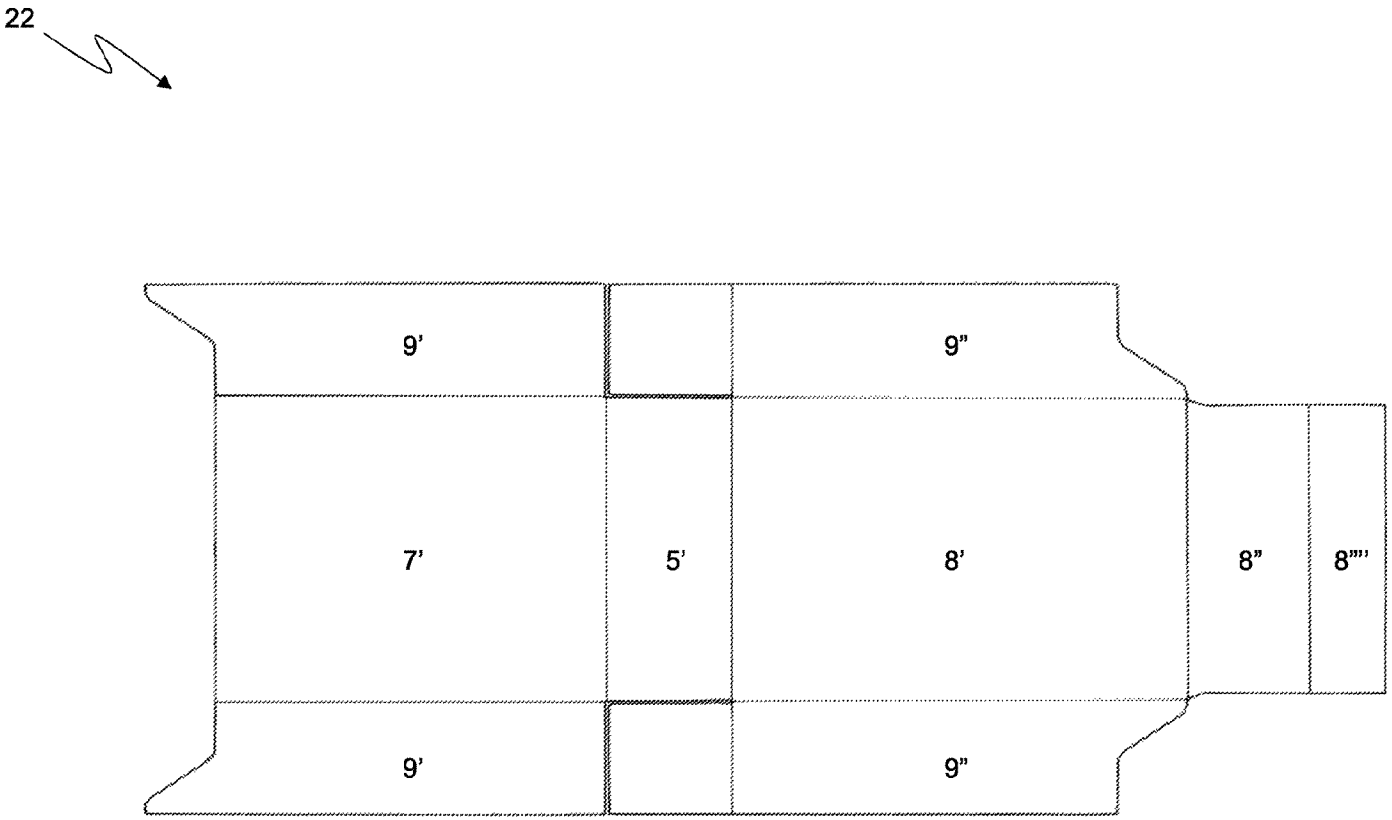
FIG. 6 shows a plan view of a blank from which to form an inner container of the FIG. 1 packet of cigarettes.
Figure 7:
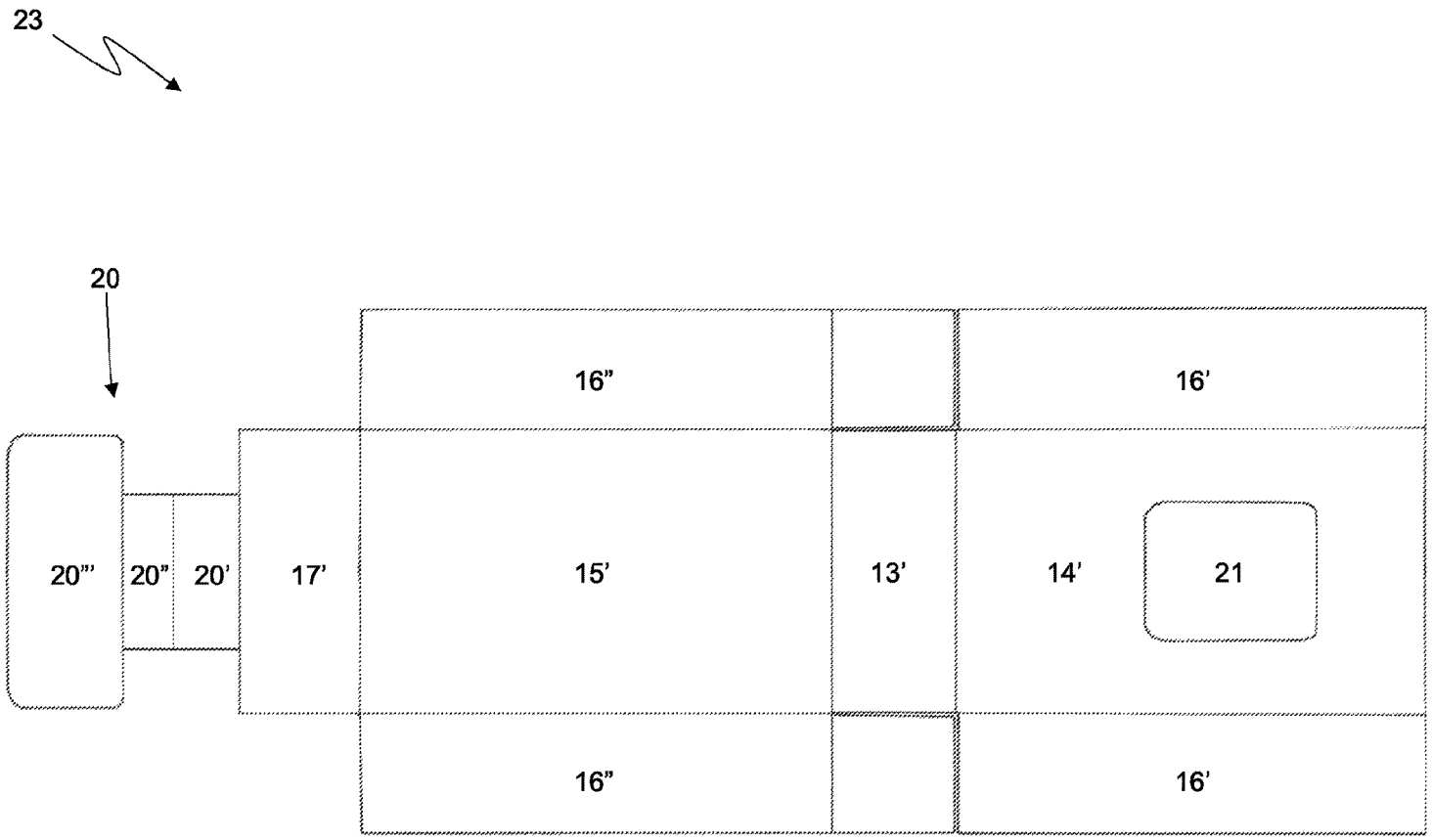
FIG. 7 shows a plan view of a blank from which to form an outer container of the FIG. 1 packet of cigarettes.

Containers 3 and 4 of the FIG. 1-5 packet 1 of cigarettes are formed from corresponding blanks 22 and 23 as shown in FIGS. 6 and 7. Among other things, each blank 22, 23 comprises a number of parts, which are indicated, where possible, using the same reference numbers, with superscripts, as for the corresponding walls of respective container 3, 4.

Figure 8:
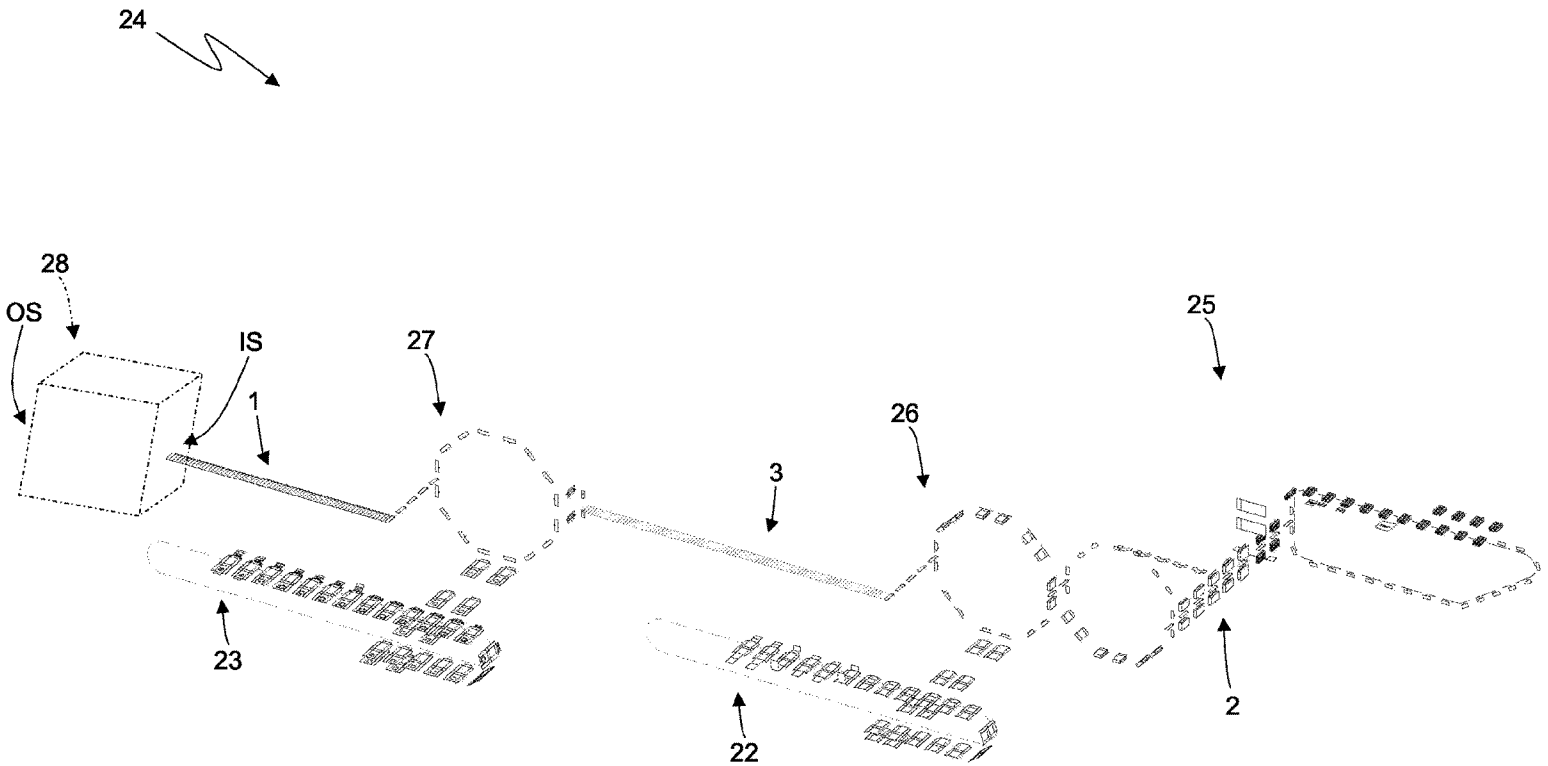
FIG. 8 shows a schematic in perspective of a packing machine for producing the FIG. 1 packet of cigarettes.

FIG. 8 shows a schematic of a cigarette packing machine 24 for producing packets 1 of cigarettes. Packing machine 24 comprises, in succession, a packing unit 25 for forming wrapped groups 2 of cigarettes; a packing unit 26 for forming inner containers 3 by folding blanks 22 about corresponding wrapped groups 2 of cigarettes; a packing unit 27 for forming outer containers 4 (and so completing packets 1 of cigarettes) by folding blanks 23 about corresponding inner containers 3; and, finally, a processing unit 28, which receives packets 1 of cigarettes from packing unit 27 and, as explained in detail below, opens (i.e. slides inner container 3 for the first time with respect to outer container 4, to extract inner container 3 and so rotate lid 11 into the open position) and closes each packet 1 of cigarettes.

Processing unit 28 opens and closes each packet 1 of cigarettes to weaken the packing material (i.e. to break or at any rate relax some of the mechanical bonds within the material) along the hinge lines, so packet 1 of cigarettes is easier to open the next time by the end user (who no longer has to overcome the resistance of the packing material along the hinge lines).

Figure 9:
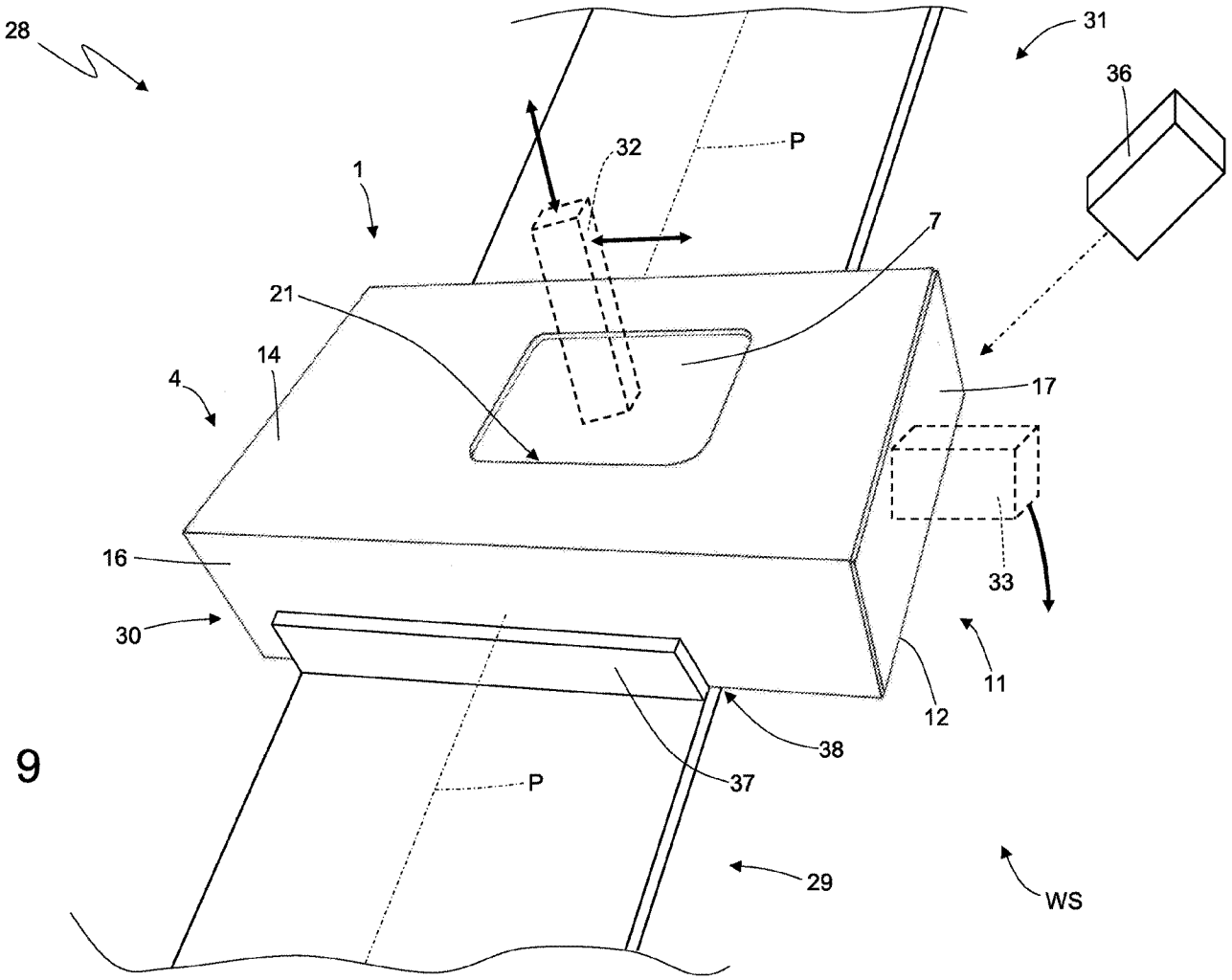
FIG. 9 shows a schematic in perspective of a processing unit of the FIG. 8 packing machine, for first-time opening the FIG. 1 packet of cigarettes.
Figure 10:
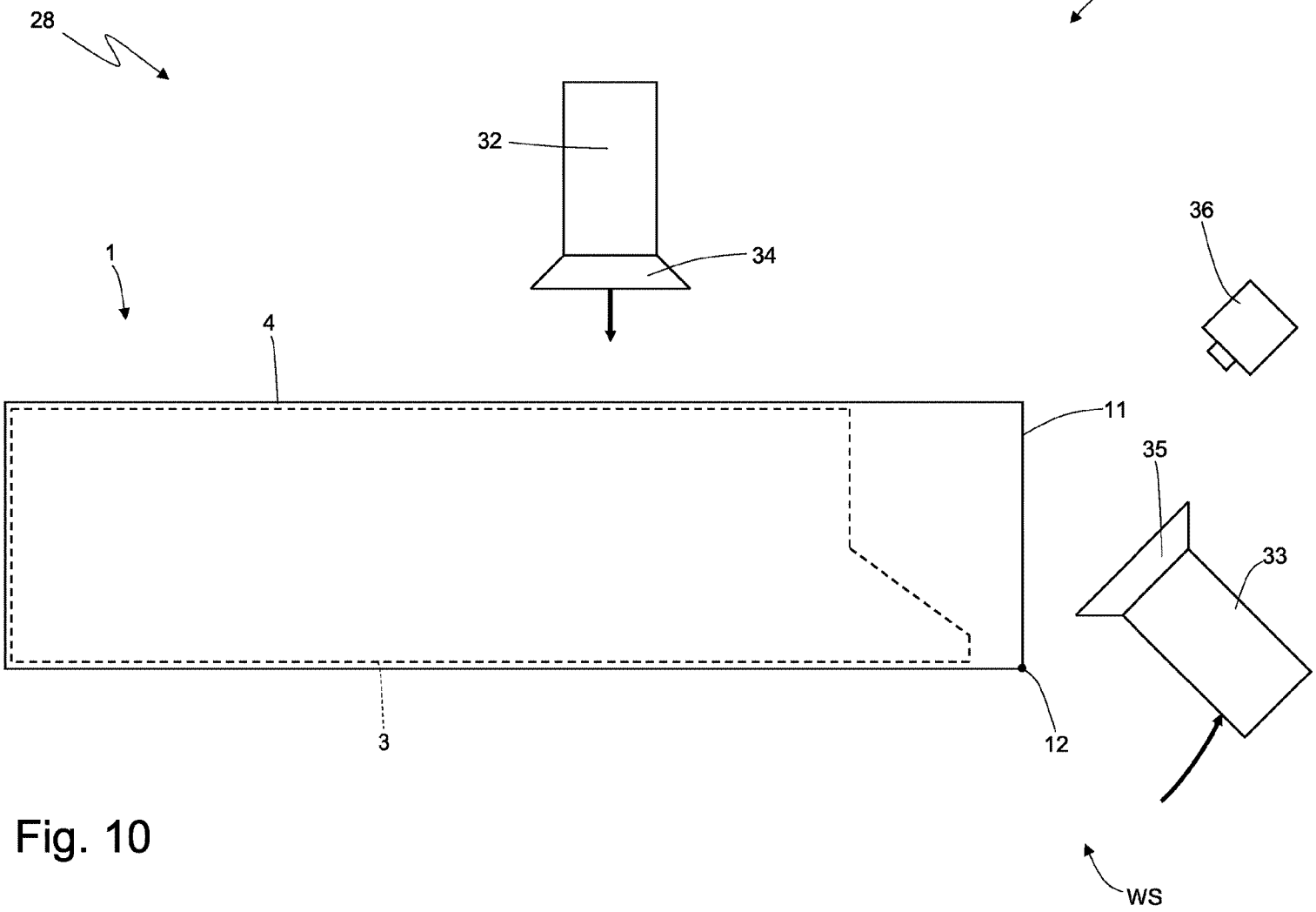
FIGS. 10-13 show four schematics of the operating sequence of the FIG. 9 processing unit.

As shown in FIG. 9, processing unit 28 comprises a belt conveyor 29, which has pockets 30 for housing and successively feeding packets 1 of cigarettes along a straight work path P extending between an input station IS and output station OS of processing unit 28. Belt conveyor 29 feeds packets 1 of cigarettes in steps along work path P, and cyclically stops each packet 1 of cigarettes at a work station WS located along work path P and comprising an actuating device 31 for opening and closing each packet 1 of cigarettes.

Actuating device 31 comprises a front actuator 32, which rests on front wall 7 of inner container 3 (through window 21 in front wall 14 of outer container 4); and a top actuator 33, which rests on top wall 17 of lid 11 of outer container 4.

Actuator 32 is movable in two perpendicular directions, i.e. is movable both perpendicular to and parallel to front wall 7 of inner container 3, and comprises a suction head 34 (FIGS. 10-13), which can be activated/deactivated to ensure sufficient grip between the base of actuator 32 and front wall 7 of inner container 3. As an alternative to suction head 34, sufficient grip between the base of actuator 32 and front wall 7 of inner container 3 may be achieved by mechanical friction; in which case, the base of actuator 32 is 'rough' to increase the friction coefficient, and actuator 32 is pressed with a given force onto front wall 7 of inner container 3.

Actuator 33 rotates about an axis of rotation coaxial (i.e. coincident) with hinge 12 of lid 11 of outer container 4, and comprises a suction head 35 (FIGS. 10-13), which can be activated/deactivated to ensure sufficient grip between the base of actuator 33 and top wall 17 of lid 11 of outer container 4.

Operation of actuating device 31 will now be described with reference to FIGS. 10-13, and to one packet 1 of cigarettes arrested (by conveyor 29) at work station WS.

To begin with (FIG. 10), as packet 1 of cigarettes moves into work station WS, actuators 32 and are positioned clear of packet 1 of cigarettes to allow it to move along work path P. As packet 1 of cigarettes is arrested at work station WS, actuators 32 and 33 are moved in to respectively contact front wall 7 of inner container 3 (through window 21 in front wall 14 of outer container 4) and top wall 17 of lid 11 of outer container 4. More specifically, actuator 32 moves perpendicularly into contact with front wall 7 of inner container 3, and actuator 33 rotates about its axis of rotation (coaxial with hinge 12 of lid 11 of outer container 4) into contact with top wall 17 of lid 11 of outer container 4.

Figure 11:
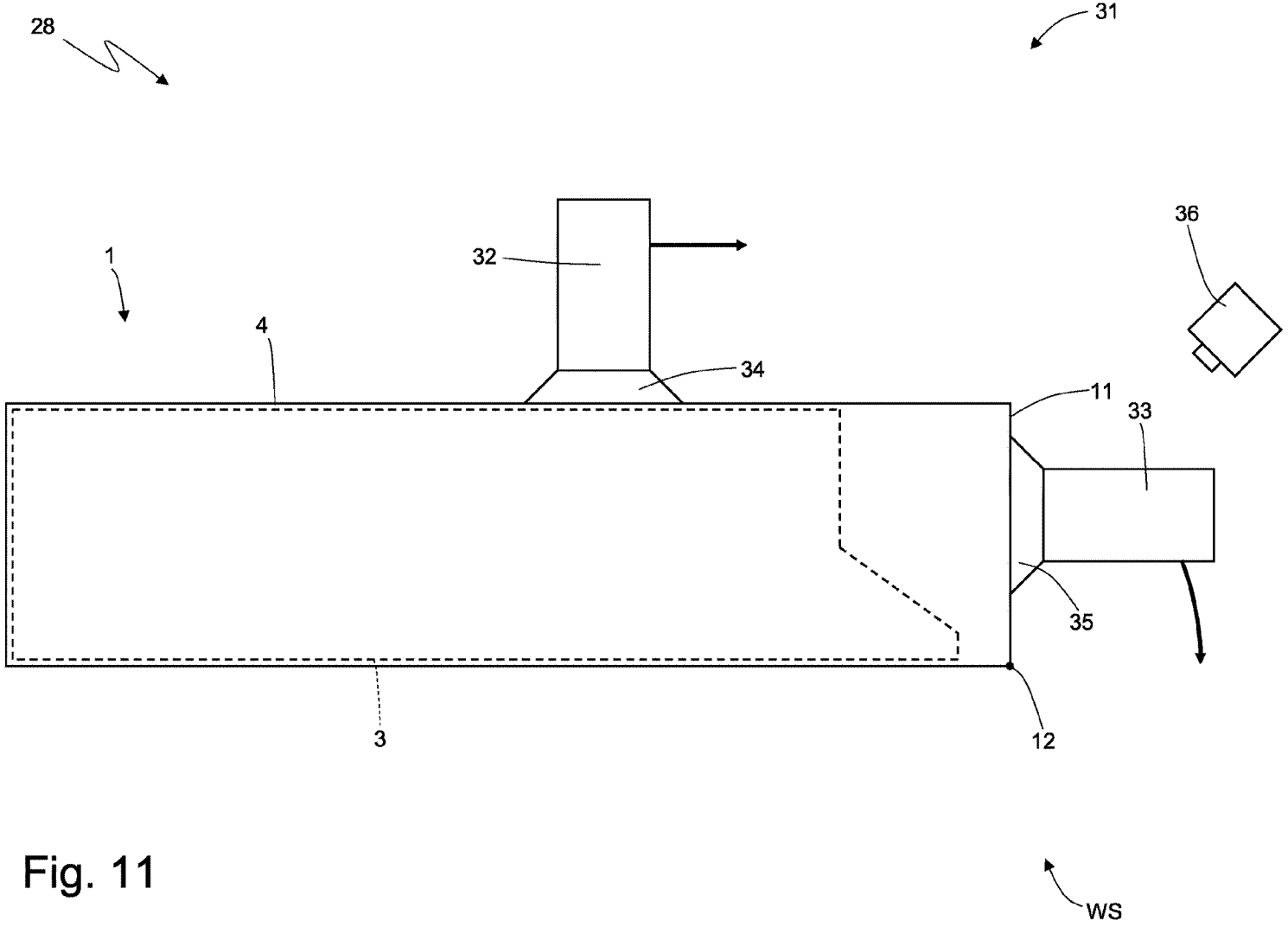

Once actuators 32 and 33 are positioned respectively contacting front wall 7 of inner container 3 and top wall 17 of lid 11 of outer container 4 (as shown in FIG. 11), suction is activated through corresponding suction heads 34 and 35 to connect suction heads 34 and 35 mechanically (by suction) to front wall 7 of inner container 3 and to top wall 17 of lid 11 of outer container 4 respectively.

Figure 12:
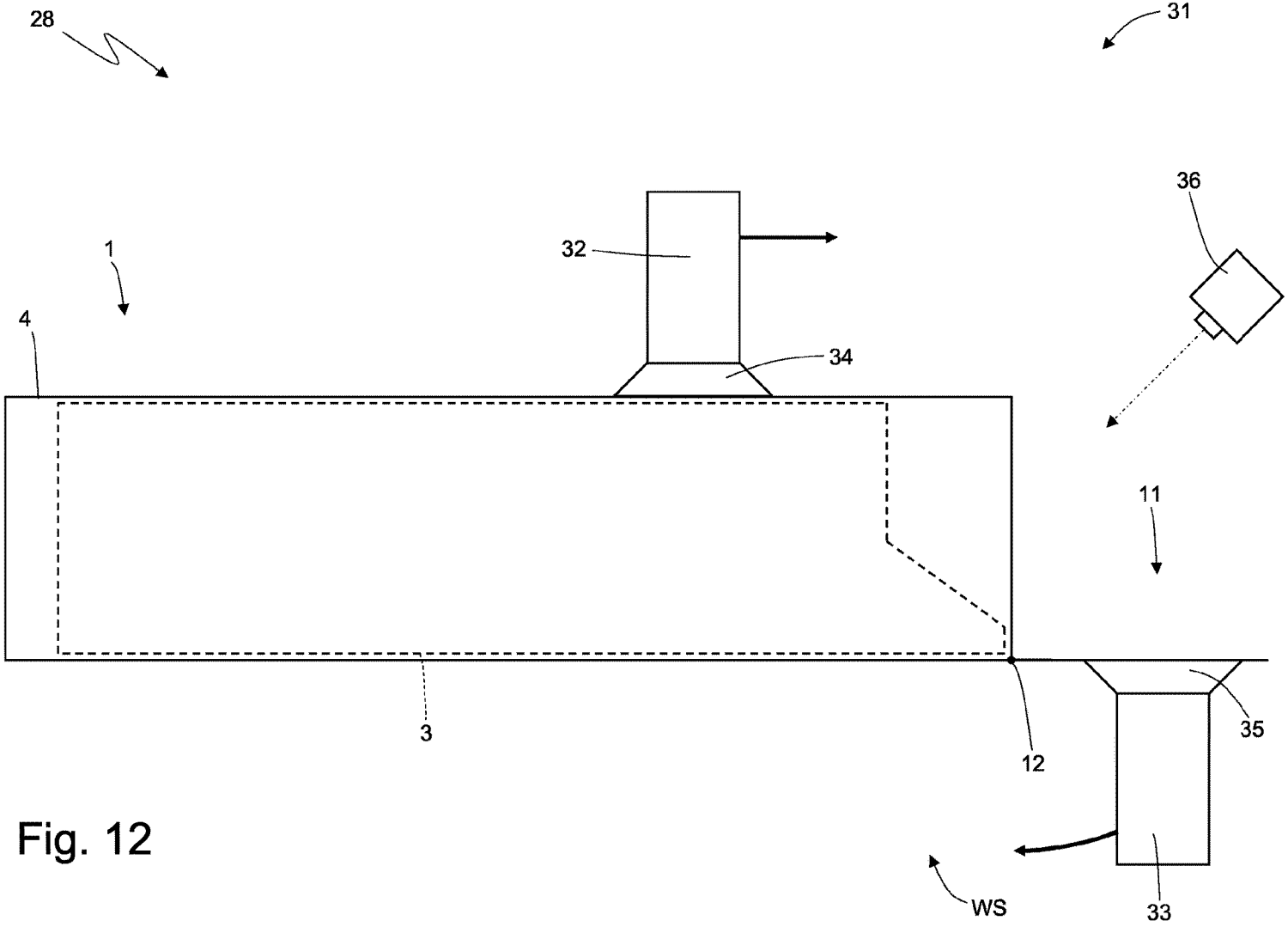

Once suction is activated through corresponding suction heads 34 and 35, actuators 32 and 33 are moved together and coordinatedly (as shown in FIG. 12) to open packet 1 of cigarettes (i.e. to slide inner container 3 with respect to outer container 4, to partly extract inner container 3 and rotate lid 11 into the open position). More specifically, actuator 32 (pushing on front wall 7 of inner container 3) is moved parallel to front wall 7 of inner container 3 to push inner container 3 axially out of outer container 4; while actuator 33 is rotated about its axis of rotation (coaxial with hinge 12 of lid 11 of outer container 4) to rotate lid 11 of outer container 4. It is important to note that, lid 11 of outer, container 4 being connected mechanically to inner container 3 by connecting tab 20, actuators 32 and 33 must operate coordinatedly (i.e. translation of actuator 32 must correspond at all times to rotation of actuator 33 according to the transmission ratio defined by the mechanics of connecting tab 20) to avoid deformation and/or tearing of packet 1 of cigarettes.

Figure 13:
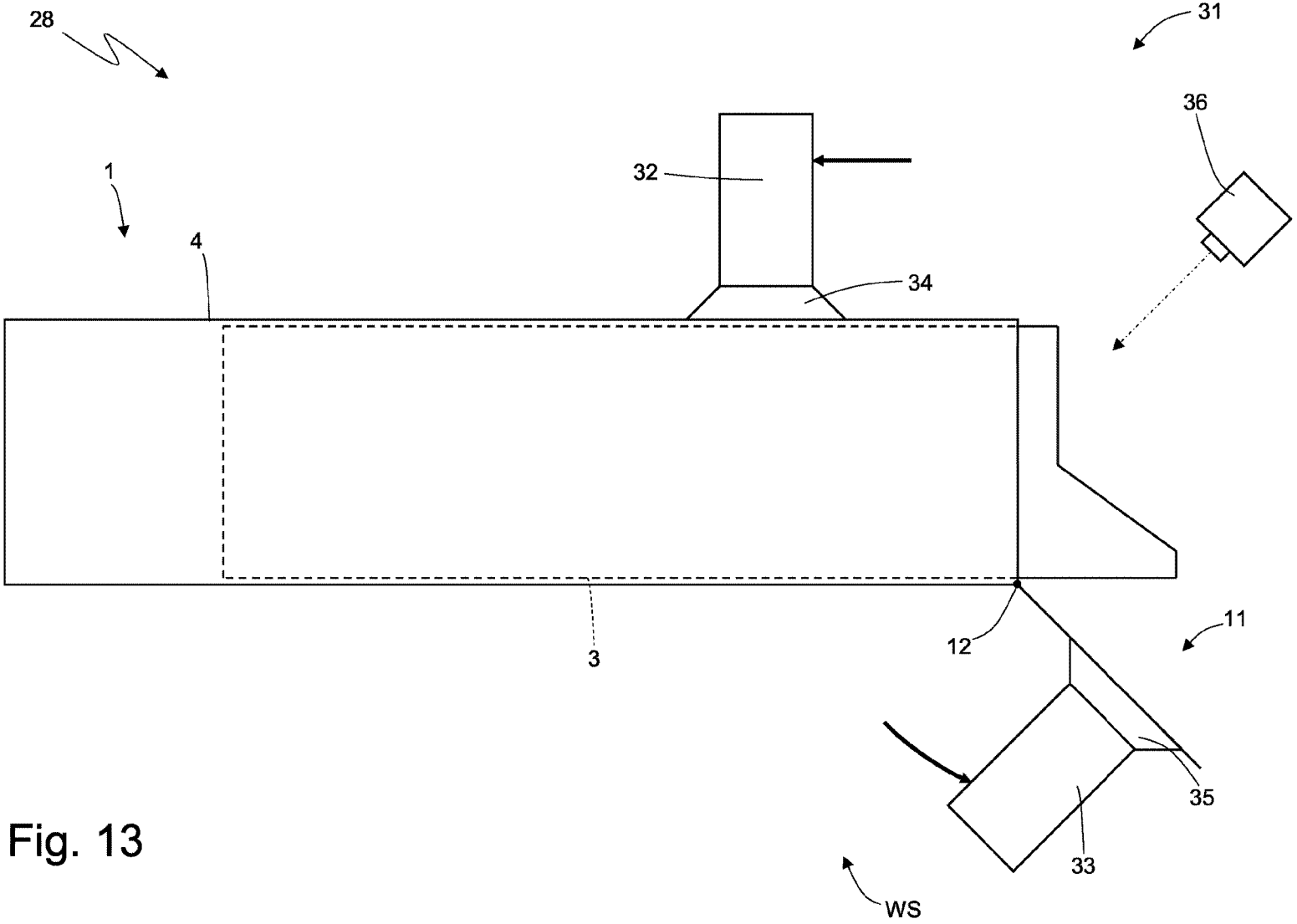

Once packet 1 of cigarettes is opened fully by actuators 32 and 33 (as shown in FIG. 13), actuators 32 and 33 are inverted to perform the above movements in reverse and so close packet 1 of cigarettes. Obviously, once packet 1 of cigarettes is closed, suction through suction heads 34 and 35 is cut off, and actuators 32 and 33 are returned to their original positions in FIG. 10 to allow packet 1 of cigarettes to move along work path P (i.e. to allow packet 1 of cigarettes to leave work station WS, and allow the next packet 1 of cigarettes to move into work station WS).

It is important to note that, besides housing packet 1 of cigarettes, pocket 30 also provides for clamping (retaining) outer container 4 mechanically, to prevent outer container 4 from moving axially, i.e. in the extraction direction of inner container 3. In fact, only by preventing outer container 4 from moving in the extraction direction of inner container 3, can thrust be exerted on inner container 3 by actuators 32 and 33 to slide inner container 3 with respect to outer container 4 (i.e. extract inner container 3 from outer container 4 to open packet 1 of cigarettes). Outer container 4 may be clamped mechanically by pocket 30 by mechanical and/or pneumatic action. Mechanical action is preferably performed by two lateral walls 37 of pocket 30, which are brought closer together to 'grip' outer container 4 (i.e. the two lateral walls 37 of pocket 30 press against lateral walls 16 of outer container 4 to grip outer container 4). In this case, lateral walls 37 are fitted in rotary manner to conveyor 29, and are rotated, for example, by a cam system which exploits the movement of conveyor 29. Pneumatic action is preferably performed by the bottom wall 38 of pocket 30, which has suction holes by which to retain rear wall 15 of outer container 4.

Work station WS has an optical control device 36 (typically a CCD television camera) located in front of lid 11 of outer container 4 to acquire images of the lid region. When lid 11 is opened by actuators 32 and 33, optical control device 36 acquires control images as shown in FIG. 3. From this type of control image, it is possible to check for flaws on the top of wrapped group 2, on walls 18 and 19 of the lid, and on connecting tab 20. Checking this part of packet 1 of cigarettes is extremely important, in that it is the part that remains concealed when packet 1 of cigarettes is closed (and so cannot be checked elsewhere on packing machine 24), and more importantly is the part the user sees when opening packet 1 of cigarettes. Downstream from (or even also along) conveyor 29, a reject station rejects any packets 1 of cigarettes failing the quality check by optical control device 36.

In one possible embodiment, a succession of 'parallel-operating' work stations WS may be provided along conveyor 29, so conveyor 29 can be stopped longer (to allow actuators 32 and 33 more time to operate, and so reduce the stress on packets 1 of cigarettes) without penalizing the output rate of conveyor 29, i.e. the production speed of packing machine 24.

Figure 14:
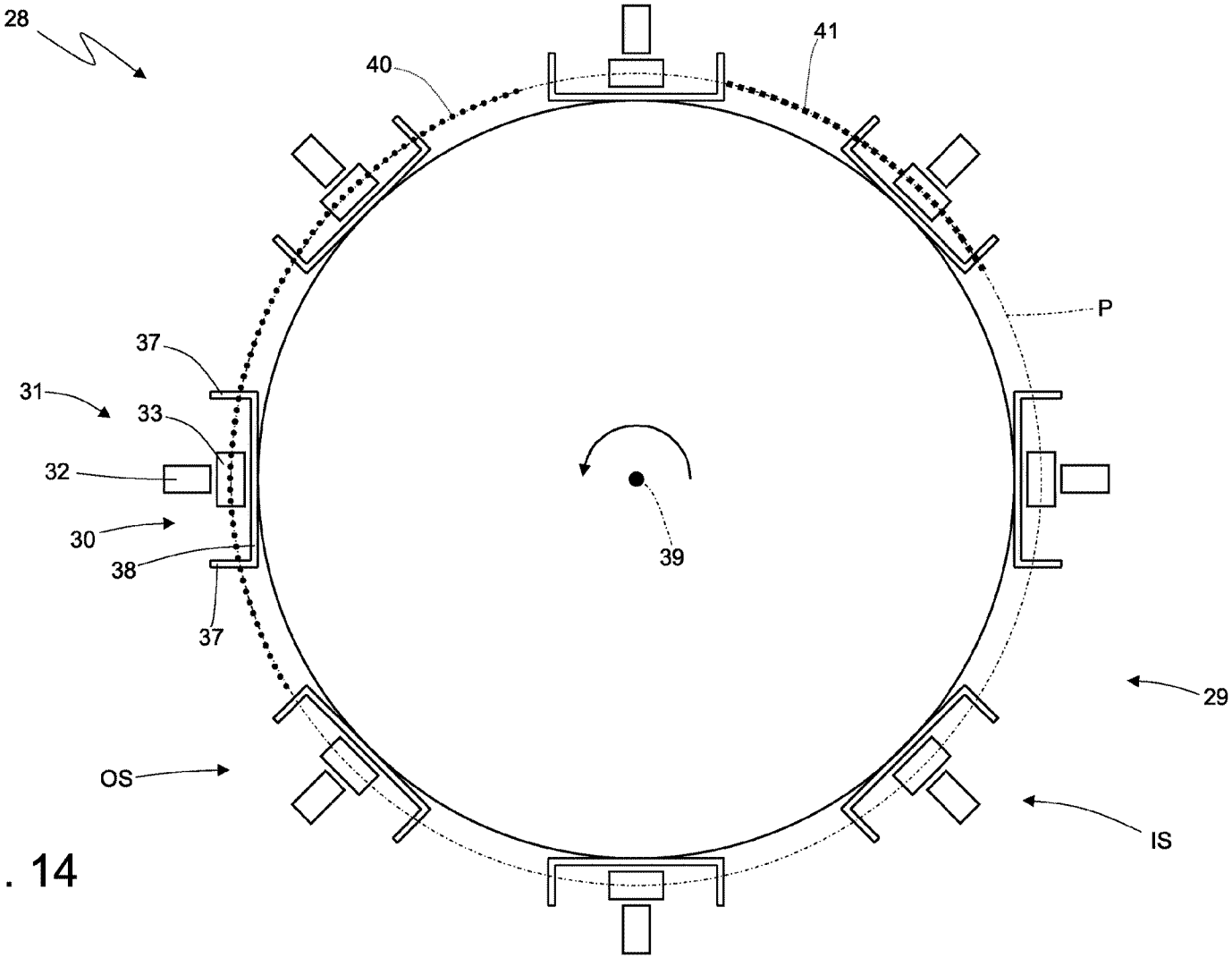
FIG. 14 shows a schematic front view of a different embodiment of the FIG. 9-processing unit.

In an alternative embodiment in FIG. 14, as opposed to being a straight belt conveyor, conveyor 29 is a wheel which rotates about a central axis of rotation 39 and supports peripheral pockets 30, so work path P is circular. In the FIG. 9 embodiment, actuating device 31 (comprising actuators 32 and 33) is stationary with respect to conveyor 29, and pockets 30 are fed successively one at a time through work station WS equipped with actuating device 31. The FIG. 14 embodiment has a number of actuating devices 31, each fitted permanently to a respective pocket 30, and therefore to conveyor 29, to move along circular work path P together with pocket 30. In the FIG. 14 embodiment, the operating time available to each actuating device 31 therefore equals the time taken for respective pocket 30 to travel from input station IS (where packet 1 of cigarettes is fed into pocket 30) to output station OS (where packet 1 of cigarettes is expelled from pocket 30). Moreover, since each actuating device 31 travels together with respective pocket 30 in the FIG. 14 embodiment, conveyor 29 may even rotate continuously (i.e. without stopping) about axis of rotation 39.

In the FIG. 14 embodiment, each pocket 30 may have its own optical control device 36 fitted to conveyor 29, or one shared stationary optical control device 36 may be located in front of conveyor 29 to successively check packets 1 of cigarettes in all of pockets 30.

In one possible embodiment, as opposed to being closed by actuators 32 and 33, packet 1 of cigarettes may be closed by a stationary folding edge 40 (shown by way of a non-limiting example in FIG. 14) located alongside conveyor 29. Stationary folding edge 40 pushes lid 11 of outer container 4 (and therefore also inner container 3 connected mechanically by connecting tab 20 to lid 11 of outer container 4) into the closed position (to close packet 1 of cigarettes) as packet 1 of cigarettes, fed along work path P by conveyor 29, moves with respect to stationary folding edge 40.

In one possible embodiment, after lid 11 of outer container 4 is opened partly by actuators 32 and 33, a stationary folding edge 41 (shown by way of a non-limiting example in FIG. 14) located alongside conveyor 29 may push lid 11 of outer container 4 into the fully-open position together with or in lieu of actuators 32 and 33. In other words, a first part of the opening movement of packet 1 of cigarettes is performed by actuators 32 and 33 acting simultaneously and synchronously on top wall 17 of lid 11 of outer container 4 and on front wall 7 of inner container 3, and the final part of the opening movement of packet 1 of cigarettes is performed by stationary folding edge 41 (on its own or together with actuators 32 and 33) pushing solely on lid 11 of outer container 4 (when stationary folding edge 41 intervenes, the packing material has already been weakened by actuators 32 and 33).

Providing stationary folding edges 40 and 41 simplifies actuators 32 and 33, which, having fewer operations to perform, have more time to move back and forth.

Figure 15:
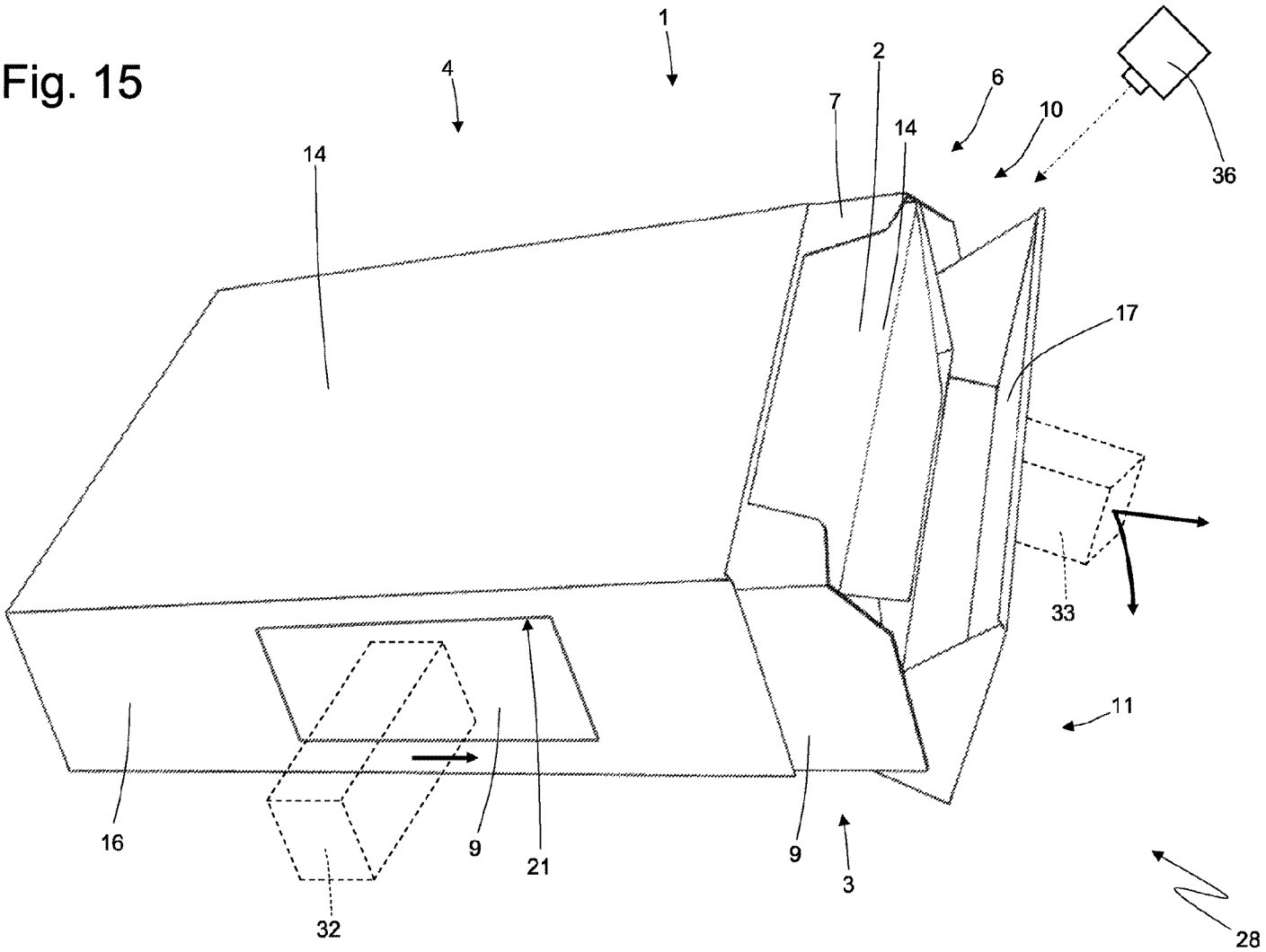
FIG. 15 shows a schematic in perspective of the FIG. 9 processing unit for first-time opening a different type of rigid, hinged-lid, slide-open packet of cigarettes.

The FIG. 1-14 embodiments first-open a packet 1 of cigarettes in which lid 11 is hinged along hinge 12 to outer container 4, and inner container 3 has no lid. It is important to note that the above processing method also applies to other types of hinged-lid, slide-open packets 1 of cigarettes. For example, FIG. 15 shows processing unit 28 as it first-opens a packet 1 of cigarettes in which outer container 4 has no lid, and inner container 3 has lid 11 hinged along hinge 12 to rear wall 8 of inner container 3. The FIG. 15 packet 1 of cigarettes also differs as to the position of window 21, which is formed through a lateral wall 16 of outer container 4 to access an underlying lateral wall 9 of inner container 3. In the FIG. 15 embodiment, in addition to rotating about an axis of rotation coaxial (i.e. coincident) with hinge 12 of lid 11 of inner container 3, actuator 33 also translates together with inner container 3; which means actuator 33 must be capable of rotating and translating, as opposed to simply rotating.

The few listed above are substantially the only differences between the FIG. 15 and FIG. 1-14 processing units 28.

The processing method described has numerous advantages.

Firstly, the processing method described provides for first-opening packets 1 of cigarettes efficiently, effectively, and, more importantly, without rough-handling (and so possibly ruining) them.

Secondly, the processing method described is highly reliable, by ensuring successful operation at all times.

The above advantages are achieved by packet 1 of cigarettes being opened by a coordinated combination of thrust on inner container 3 by actuator 32 pushing on front wall 7 (or lateral wall 9) of inner container 3, and pull on lid 11 by actuator 33. The combined action of both actuators 32 and 33 provides for distributing mechanical stress over the whole of packet 1 of cigarettes (as opposed to concentrating stress in a limited area of it), thus preventing damage to packet 1 of cigarettes and ensuring the success of the operation.

It is important to note that first-opening packets 1 of cigarettes not only serves to weaken the packing material to make the packet easier to open later, but also permits optical quality control underneath lid 11 to ensure a high quality standard of the finished packets 1 of cigarettes.

The invention claimed is:

1. A processing method for automatically opening a slide-open package of tobacco articles with a hinged lid; the package comprising:

an inner container housing a group of tobacco articles and having an open top end;

an outer container housing the inner container to allow the inner container to slide with respect to the outer container between a closed configuration, in which the inner container is inserted inside the outer container, and an open configuration, in which the inner container is partly expelled from the outer container; and a hinged lid which, when closed, closes the open top end of the inner container;

the processing method comprising the steps of:

mechanically clamping the outer container; and exerting pull on the lid to rotate the lid into an open position by means of a first actuator, which contacts a top wall of the lid, and has a first suction head which engages the top wall by suction;

the processing method being characterized by comprising the further step, simultaneous and coordinated with the step of exerting pull on the lid, of exerting thrust on the inner container, to slide the inner container axially with respect to the outer container, by means of a second actuator, which contacts a wall of the inner container through a window formed through a corresponding wall of the outer container.

2. A processing method as claimed in claim 1, wherein the second actuator has a second suction head, which engages the wall of the inner container by suction.

3. A processing method as claimed in claim 1, and comprising the further step of inserting the package into a pocket of a conveyor, which feeds the package along a work path to open the package.

4. A processing method as claimed in claim 3, wherein the step of mechanically clamping the outer container comprises clamping the outer container mechanically to the pocket of the conveyor by the mechanical action of two lateral walls of the pocket, which are moved closer together to grip the outer container.

5. A processing method as claimed in claim 3, wherein the step of mechanically clamping the outer container comprises clamping the outer container mechanically to the pocket of the conveyor by the pneumatic action of at least one wall of the pocket, which has suction holes for exerting suction on a corresponding wall of the outer container.

6. A processing method as claimed in claim 3, wherein the actuators are fitted to the conveyor to move along the work path together with the pocket.

7. A processing method as claimed in claim 3, wherein the actuators are stationary with respect to the conveyor, and the pocket is fed through a work station where the actuators are installed.

8. A processing method as claimed in any one of claim 3, wherein the conveyor is a wheel which rotates about a centre axis of rotation to feed the pocket along a circular work path.

9. A processing method as claimed in any one of claim 1, and comprising the further steps of:

performing an initial part of the opening movement of the package by means of the two actuators; and performing a final part of the opening movement of the package by means of a first stationary folding edge located alongside the conveyor, and which pushes solely on the lid.

10. A processing method as claimed in any one of claim 1, and comprising the further step of closing the package, once the package is opened completely, by means of a second stationary folding edge located alongside the conveyor, and which pushes solely on the lid.

11. A processing method as claimed in claim 1, wherein the second actuator is movable in two perpendicular directions, so as to move both perpendicularly to the wall of the inner container, and parallel to the wall of the inner container.

12. A processing method as claimed in claim 1, wherein the first actuator rotates about an axis of rotation coaxial with a hinge of the lid.

13. A processing method as claimed in claim 1, and comprising the further steps of:

acquiring, by means of an optical control device in front of the lid, at least one control image of the lid region of the package when the lid is open; and using the control image to check the quality of the package and determine possible rejection of the package.

14. A processing unit for automatically opening a slide-open package of tobacco articles with a hinged lid; the package comprising:

an inner container housing a group of tobacco articles and having an open top end;

an outer container housing the inner container to allow the inner container to slide with respect to the outer container between a closed configuration, in which the inner container is inserted inside the outer container, and an open configuration, in which the inner container is partly expelled from the outer container; and a hinged lid which, when closed, closes the open top end of the inner container;

the processing unit comprising:

a clamping member for mechanically clamping the outer container; and a first actuator, which contacts a top wall of the lid, and has a first suction head which engages the top wall by suction to exert pull on the lid to rotate the lid into an open position;

the processing unit being characterized by comprising a second actuator, which contacts a wall of the inner container through a window formed through a corresponding wall of the outer container, to exert thrust on the inner container, simultaneously and in coordination with the pull exerted on the lid, to slide the inner container axially with respect to the outer container.

* * * * *